US005126392A

United States Patent [19]

Nakashima et al.

[11] Patent Number: 5,126,392

[45] Date of Patent: Jun. 30, 1992

[54] SHADE ENHANCING AGENT

[75] Inventors: Norihiko Nakashima; Yoshinobu Ishikawa; Akihiro Kondo, all of Wakayama; Masaki Tumadori, Utsunomiya, all of Japan

[73] Assignee: Kao Corporation, Tokyo, Japan

[21] Appl. No.: 462,312

[22] Filed: Dec. 22, 1989

Related U.S. Application Data

[62] Division of Ser. No. 53,177, May 21, 1987.

[30] Foreign Application Priority Data

Jun. 2, 1986 [JP] Japan ..... 61-127451
Jun. 2, 1986 [JP] Japan ..... 61-127452
Jun. 2, 1986 [JP] Japan ..... 61-127453

[51] Int. Cl.[5] ..... C08F 2/16; C08K 3/20; C08L 21/02

[52] U.S. Cl. ..... 524/458; 524/457; 524/459; 524/714; 524/832; 524/833; 252/162

[58] Field of Search ..... 252/162; 524/832, 833, 524/714, 457, 458, 459

[56] References Cited

U.S. PATENT DOCUMENTS 3,684,759 8/1972 Reiff ..... 524/507
3,836,493 9/1974 Matsuda et al. ..... 260/29.2 TN
3,914,196 10/1975 Loeffler ..... 260/29.7 H
3,926,890 12/1975 Huang ..... 260/29.6 H
3,956,163 5/1976 Lee ..... 252/171
3,970,725 7/1976 Tugukuni ..... 525/208
4,308,189 12/1981 Moritani ..... 524/459
4,373,043 2/1983 Yagi et al. ..... 524/130
4,373,053 2/1983 Sato ..... 524/457
4,564,664 1/1986 Chang ..... 524/833
4,659,771 4/1987 Craig ..... 524/700
4,689,159 8/1987 Makashima ..... 252/8.6
4,727,110 2/1988 Fan ..... 524/801

FOREIGN PATENT DOCUMENTS 1377670 9/1964 France .
50-98990 8/1975 Japan .
57-61784 4/1982 Japan .
57-112480 7/1982 Japan .
59-100776 11/1984 Japan .
2081724 2/1982 United Kingdom .

*Primary Examiner*—John Niebling
*Assistant Examiner*—Mark Bender
*Attorney, Agent, or Firm*—Flynn, Thiel, Boutell & Tanis

[57] ABSTRACT

A shade enhancing agent comprises an aqueous resin emulsion composition obtained by polymerizing a monomer in the presence of a cationic surfactant or a cationic protective colloid, polymerizing a monomer and adding a cationic protective colloid or polymerizing a monomer in the presence of a cationic or nonionic emulsifying dispersant so as to have a cationic group in the molecule, a dry film of said composition having a glass transition point (Tg) in the range between 20° C. and 110° C. and a refractive index of 1.50 or less, said emulsion composition having a zeta potential in the range between +5 and +80 mV at an ion strength of $10^{-3}$ and a pH value of 7.

14 Claims, No Drawings

SHADE ENHANCING AGENT

This application is a division of U.S. Ser. No. 07/053,177, filed May 21, 1987.

The invention relates to a shade enhancing agent or color deepening agent for fibrous products. In particular, the invention relates to a shade enhancing agent capable of improving the colorability of a substance to be dyed and also improving the deepness and vividness of the color.

PRIOR ART AND PROBLEMS

A serious defect of synthetic fibers, particularly polyester fibers, is that their color deepness and vividness provided by dyeing are inferior to those of natural fibers such as wool and silk. Investigations were made, therefore, for the purpose of improving the deepness and vividness of the dyed fibers and several processes have been reported.

For example it is described in "Senryo to Yakuhin", 15, No. 1, pages 3 to 8 (1970) that when a dyed cloth is treated with a resin-finishing agent having a low refractive index, a color-deepening effect, similar to that provided when and cloth is wet with water having a refractive index of 1.33, can be provided. This is described therein theoretically and experimentally based on the fact that the deepness and vividness of the dyed cloth are increased when it is wet with water. It is also described therein that this phenomenon is caused by a reduction of the surface reflectance. In the summary of a discussion entitled "the fiber surface and colorability"described in "Sen'i Kôgaku", 26, No. 3, 186 (1973), it is mentioned that the formation of a layer having a suitable refractive index on the polyester fiber surface is effective in reducing the reflectance on the surface layer and increasing the quantity of light coming into the fiber to improve the dyeability of polyester fibers with a disperse dye and that the color of dyed PET filaments can be deepened by coating them with a low polymer of trifluorochloroethylene (refractive index: 1.4).

Various processes developed on the basis of the above-mentioned facts have been proposed. A fiber structure having a thin film made of a polymer having a refractive index of 1.50 or less is disclosed in Japanese Patent Laid-Open No. 111192/1978 and a process for producing the structure is also disclosed therein which comprises placing a monomer capable of forming a polymer having a refractive index of 1.5 or less in a closed vessel together with the fibers and conducting plasma polymerization or discharge graft polymerization to form the thin film. Japanese Patent Publication No. 51557/1983 discloses a process wherein 0.3 to 10%, based on fibers, of a compound having a refractive index of as low as 1.45 or less is adsorbed on the surface of a fibrous structure to form a thin film and it is subjected to a dry or wet heat treatment. It is described therein that fluoro-resins, acrylic ester resins, vinyl polymers and silicon resins having a refractive index of 1.45 or less can be used as the starting material for the thin film. In examples given therein, the thin film is formed on the fiber surface by immersing the fibers in an emulsion or solution of a fluorine compound or acrylic ester at a high temperature to conduct the adsorption or by spraying the emulsion or solution on the fibers and subjecting the fibers to dry or wet heat treatment The process disclosed in Japanese Patent Laid-Open No. 111192/1978 is unsuitable for the production on an industrial scale, since it has defects that it is of a batch system having a low efficiency, that it necessitates a special apparatus, and that the polymer adheres to the walls of the vessel in the course of the polymerization of the monomer to increase its loss and to make the washing of the vessel troublesome. The process disclosed in Japanese Patent Publication No. 51557/1983 in which a high bath ratio is necessitated in the immersion has also a defect that a large amount of the solution must be heated to a high temperature and, therefore, much energy is required to increase the cost, since homogeneous adsorption cannot be effected at a low temperature.

Japanese Patent Publication No. 30796/1985 discloses a color deepening agent comprising an aqueous resin composition prepared by polymerizing a polymerizable monomer having an unsaturated bond in the presence of a thermoplastic polyurethane emulsion, characterized in that a dry film of the aqueous resin composition has a refractive index of 1.50 or less. Though this color deepening agent is capable of deepening a color of a cloth easily on an industrial scale, it has a defect that the cloth thus treated is yellowed by light, heat, etc., since it contains the polyurethane emulsion.

SUMMARY OF THE INVENTION

After intensive investigations of the functions needed for providing the shade enhancing effects, made for the purpose of finding a shade enhancing agent free of the above-mentioned defects, the inventors have found the following facts:

The treatment with a shade enhancing agent comprises the following adsorption step (1) and film-forming step (2):

(1) Adsorption step:

A shade enhancing agent is adsorbed on the fibers mainly due to an electrostatic interaction between the shade enhancing agent and the fibers. Since the fibers have a negative charge in water, a positive charge is required from the shade enhancing agent for it to uniformly onto the fibers. However, when the positive charge is excessively strong, the stability in water becomes too high to conduct the suitable adsorption.

(2) Film-forming step:

The particles of the shade enhancing agent adsorbed on the fibers are fused during the drying to form a film. It has been considered that there is only one requisite in this step namely a low refractive index. However, after the investigations, the inventors have found that a substance having a low refractive index and a high glass transition temperature forms micro-craters on the fiber surface after the drying to exhibit an excellent color-deepening effect.

Thus, after intensive investigations, the inventors have found that the properties required of the shade enhancing agent ae zeta potential in the adsorption step and the refractive index and Tg in the film-forming step and that the yellowing of the treated cloth by light or heat can be inhibited by using a cationic surfactant as an emulsifier. The present invention has been completed on the basis of these findings.

A shade enhancing agent may comprise an aqueous resin emulsion composition obtained in an aqueous medium by:

(1) polymerizing a polymerizable monomer having a an unsaturated bond, in the presence of a cationic surfactant, (2) polymerizing a polymerizable monomer having a an unsaturated bond, in the presence of a cationic protective colloid, (3) polymerizing a polymerizable monomer having a an unsaturated bond, in the presence of an emulsifying dispersant and then adding a cationic protective colloid to the polymerization mixture or (4) polymerizing a polymerizable monomer having a an unsaturated bond, in the presence of a cationic or nonionic emulsifying dispersant so as to have a cationic group in the molecule, a dry film of said composition having a glass transition temperature (Tg) in the range between 20° C. and 110° C. and a refractive index of 1.50 or less, said emulsion composition having a zeta potential in the range between +5 and +80 mV at an ion strength of $10^{-3}$ and a pH value of 7.

It is preferred that the component is a mixture of a first monomer with another monomer having a reactive group to effect a crosslinking reaction. In particular the monomer component comprises a mixture of a first unsaturated monomer and another unsaturated monomer having and a reactive group to effect a crosslinking reaction, at a weight ratio of 99.9/0.1 to 50/50.

It is preferable from the practical point of view, that the polymerization reaction mixture comprises (1) 50 to 99.5 wt. % of the monomer component, (2) 0.5 to 50 wt. % of the cationic surfactant, the cationic protective colloid or the cationic or nonionic emulsifying dispersant and (3) water. The resulting emulsion composition preferably has a solid content of 0.1 to 50 grams per 1 liter.

A preferable embodiment of the polymerization (4) comprises using a monomer having a cationic group or using a monomer having a reactive group to form a polymer having a cationic group and reacting the obtained polymer with a compound to introduce a cationic group thereinto.

The invention further provides a method for enhancing the shade of a fibrous material by treating the fibrous material with the shade enhancing agent as defined above before, after or during dyeing the fibrous material.

In a preferable embodiment of the method, the shade enhance agent having a solid content of 0.1 to 50 grams per liter is applied to the fibrous material so as to have 0.1 to 10 percent by weight, based liter on the weight of the fibrous material, preferably 0.3 to 5 percent by weight, of the solid component of the shade enhancing agent applied on the fibrous material. The treatment may be effected by padding, drying and curing or dipping, dehydrating and drying in air. The padding temperature, the drying temperature and the curing temperature are 5° to 35° C., 80° to 120° C. and 150° to 200° C., respectively. The dipping temperature and the air-drying temperature are 5° to 70° C. and room temperature, respectively.

DETAILED DESCRIPTION OF THE INVENTION

The invention will be explained in detail in respect to the emulsion composition obtained by different polymrizations (1), (2), (3) and (4).

The emulsion obtained by the cationic surfactant polymerization, reference numeral (1) as earlier set forth is described below.

A color deepening agent can be prepared comprising an aqueous resin composition prepared by polymerizing a polymerizable monomer having an unsaturated bond, in the presence of a cationic surfactant, characterized in that a dry film of the aqueous resin composition has a glass transition temperature (Tg) in the range of 20° to 110° C. and a refractive index of 1.50 or less and an emulsion of the aqueous resin composition has a zeta potential in the range of +5 to +80 mV (determined under conditions comprising an ionic strength of $10^{-3}$ and a pH of 7).

The usable cationic surfactants include, for example, alkyl quaternary ammonium salts of the following formula (1), quaternary ammonium salts of the formula (2) in which part of the alkyl groups are replaced with a monovalent organic group having an ester bond and an amido bond, quaternary ammonium salts of the formula (3) in which part of the alkyl groups ar replaced with hydroxyethyl groups, alkylbenzyl quaternary ammonium salts of the formula (4), alkylpyridinium salts of the formula (5), alkylimidazolinium salts of the formula (6), alkylmorpholinium salts of the formula (7), alkylamine salts of the formulae (8), (9) and (10), and polymerizable cationic surfactants of the formulae (11) and (12) having an unsaturated bond:

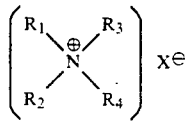
(1)

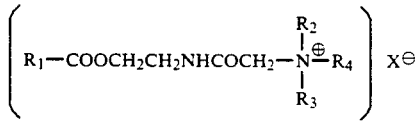
(2)

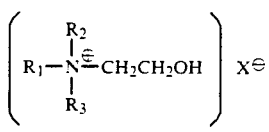
(3)

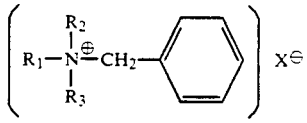
(4)

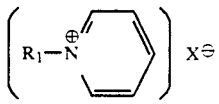
(5)

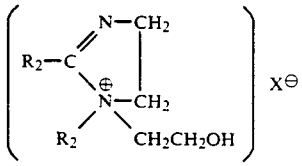
(6)

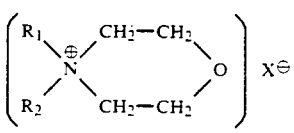
(7)

$R_1-NH_2.HX$ (8)

-continued

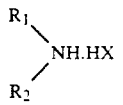

(9)

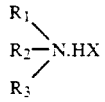

(10)

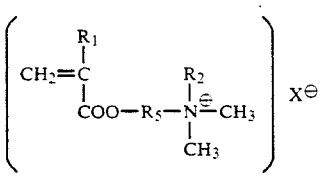

(11)

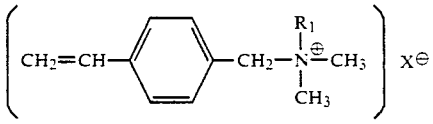

(12)

wherein $R_1$, $R_2$, $R_3$ and $R_4$ each represent an alkyl group having 1 to 22 carbon atoms, $R_5$ represents an alkylene group having 1 to 22 carbon atoms and X represents a monovalent anionic group such as Cl, Br, I, $CH_3SO_4$, $C_2H_5SO_4$, $NO_3$, $ClO_4$ or $HOCH_2COO$.

The polymerizable monomers having an unsaturated soluble in the present invention are radicalpolymerizable compounds including fluorinated acrylic or methacrylic esters such as pentadecafluorooctyl acrylate ($n_D$=1.339), tetrafluoro-3-(Pentafluoroethoxy)propyl acrylate ($n_D$=1.35), heptafluorobutyl acrylate ($n_D$=1.367), 2-(heptafluorobutoxy)ethyl acrylate ($n_D$=1.39), trifluoroisopropyl methacrylate ($n_D$=1.42) and 2,2,2-trifluoro-1-methylethyl methacrylate ($n_D$=1.42); vinyl ethers such as vinyl isobutyl ether ($n_D$=1.45), vinyl ethyl ether ($n_D$=1.454) and vinyl butyl ether ($n_D$=1.456); $\alpha,\beta$-unsaturated carboxylic esters such as butyl acrylate ($n_D$=1.46), ethyl acrylate ($n_D$=1.47), 2-ethoxyethyl acrylate ($n_D$=1.471), isopropyl methacrylate ($n_D$=1.473), n-butyl methacrylate ($n_D$=1.483), n-hexyl methacrylate ($n_D$=1.4813) and methyl methacrylate ($n_D$=1.49); and vinyl esters such as vinyl acetate ($n_D$=1.4665) and vinyl propionate ($n_D$=1.4665), all of which are $\alpha,\beta$-unsaturated compounds. The monomers selected from the above-mentioned compounds can be used either singly or as a combination of two or more of them.

An emulsion of an aqueous resin composition which is produced by polymerizing a mixture of (1) a polymerizable monomer having both an unsaturated bond and a crosslinkable group and (2) a monomer having an unsaturated bond provides excellent color deepening effects.

The polymerizable monomers having both an unsaturated bond and a crosslinkable group include $\alpha$, $\beta$-unsaturated carboxylic acids such as itaconic acid, acrylic acid, methacrylic acid, fumaric acid and maleic acid; $\alpha$, $\beta$-unsaturated carboxamides such as acrylamide, methacrylamide, maleamide and maleimide; substituted unsaturated carboxylic acid amides such as methylolacrylamide, methylolmethacrylamide, methoxymethylacrylamide and N-isobutoxymethylacrylamide; heterocyclic vinyl compounds such as vinylpyridine and vinylpyrrolidone; allyl compounds such as allyl alcohol and allyl acetate; and glycidyl methacrylate They are usable as an additive component for improving the reactivity. The monomers selected from the abovementioned compounds can be used either singly or as a combination of two or more of them.

The molar ratio of (1) the polymerizable monomer having an unsaturated bond to (2) the polymerizable monomer having both an unsaturated bond and a crosslinkable linkable group is preferably in the range of 99.9/0.1 to 50/50.

The polymerizable monomer having an unsaturated bond or a mixture thereof with the polymerizable monomer having both an unsaturated bond and a crosslinkable group is subjected to a radical emulsion polymerization in the presence of a cationic surfactant. The polymerization catalysts used preferably in the polymerization include for example, peroxides such as potassium persulfate, ammonium persulfate, hydrogen peroxide, benzoyl peroxide, t-butyl hydroperoxide, succinic acid hydroperoxide, cumene hydroperoxide, p-menthane hydroperoxide, di-tert-butyl peroxide and tert-butyl perbenzoate; and azobis initiators such as 2,2'-azobis(2-amidinopropane) hydrochloride and azobiscyclohexanecarbonitrile. The polymerization catalysts can be used, if necessary, in combination with activators such as water-soluble amines, e.g. ethylenediamine, diethylenetriamine, triethylenetetramine, tetraethylenepentamine, pentaethylenehexamine, monoethanolamine, diethanolamine, triethanolamine, propylenediamine, diethylamine and monoethylamine; pyrosulfurous acid; sodium hyposulfite; and sodium formaldehyde sulfoxylate. Further, polymerization regulators such as organic halogen compounds, nitro compounds, alkylmercaptans and diisopropylxanthogenic acid can be used.

The emulsion polymerization reaction is conducted by suitably mixing the above-mentioned polymerizable monomer(s), catalyst, catalyst activator and polymerization regulator in the presence of the cationic surfactant according to a known process.

Although the mixing ratio of the cationic surfactant to the polymerizable monomer(s) is not particularly limited, it is preferred to use 0.5 to 50 wt. % of the cationic surfactant and 99.5 to 50 wt. % of the polymerizable monomer(s). More preferably, 2 to 30 wt. % of the former and 98 to 70 wt. % of the latter are used.

Described below are the emulsions obtained by the polymerization techniques numbered 2 and 3, respectively, polymerization in the presence of a cationic protective colloid and polymerization in the presence of an emulsifying dispersant with a cationic protective colloid are described below.

The present invention is directed to a color deepening agent comprising an aqueous resin composition prepared by polymerizing a polymerizable monomer, having an unsaturated bond, in the presence of a cationic protective colloid. A color deepening aqueous resin composition may also be prepared by polymerizing a polymerizable monomer having an unsaturated bond in the presence of an emulsifying dispersant and adding a cationic protective colloid to the product, wherein a dry film of the aqueous resin composition has a glass transition temperature (Tg) in the range of 20° to 110° C. and a refractive index of 1.50 or less and an emulsion of the aqueous resin composition has a zeta potential in the range of +5 to +80 mV (determined under conditions comprising an ionic strength of $10^{-3}$ and a pH of 7).

The cationic protective colloids usable in the present invention must have a basic nitrogen atom or a cationic nitrogen atom and further they may have a group of a carboxylic acid salt, sulfonic acid salt, amide or enter in the molecule. They include the following substances (a) to (i):

(a) homopolymers of salts of nitrogen-containing monomers or quaternary ammonium salts of the following general formulae (I) to (V) or copolymers of two or more of them:

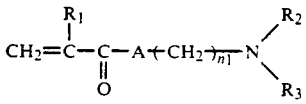

(I)

wherein A represents —O— or —NH—, n represents an integer of 1 to 3, $R_1$ represents H or $CH_3$ and $R_2$ and $R_3$ each represent H, $CH_3$ or $C_2H_5$,

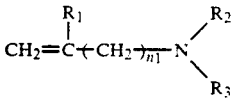

(II)

wherein $R_1$, $R_2$, $R_3$ and $n_1$ are as defined above,

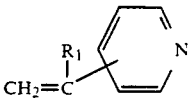

(III)

wherein $R_1$ is as defined above and the pyridine nucleus is bonded at position 2 or 4,

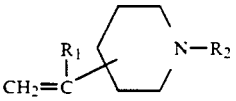

(IV)

wherein $R_1$ and $R_2$ are as defined above and the pyperidine nucleus is bonded at position 2 or 4,

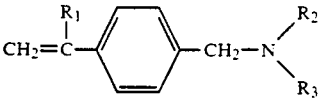

(V)

wherein $R_1$, $R_2$ and $R_3$ are as defined above.

Examples of the monomers include dimethylaminoethyl acrylate, diethylaminoethyl acrylate, dimethylaminoethyl methacrylate, dimethylaminopropyl methacrylate, dimethylaminopropylacrylamide, diemthylaminopropylmethacrylamide and diethylaminopropylmethacrylamide of the formula (I); dimethylaminomethylethylene, diethylaminomethylethylene, dimethylaminomethylpropene and diethylaminomethylpropene of the formula (II); vinylpyridine of the formula (III), vinylpiperidine and vinyl-N-methylpiperidine of the formula (IV); and vinylbenzylamine and vinyl-N,N-dimethylbenzylamine of the formula (V).

The homopolymers and copolymers of these monomers usable in the present invention have an average molecular weight of 1,000 to 10,000,000.

(b) copolymers of (1) one or more of the nitrogen-containing monomers of the above general formulae (I) to (V) and their salts or quaternary ammonium salts with (2) one or more vinyl monomers selected from the group consisting of $\alpha$, $\beta$-unsaturated carboxylic acids and their salts and derivatives, vinyl compounds having a sulfonic acid group and their salts, acrylonitrile, vinylpyrrolidone and aliphatic olefins having 2 to 20 carbon atoms.

Examples of the vinyl monomers include vinylpyrrolidone and acrylonitrile; acrylic acid, methacrylic acid, maleic acid and their alkali metal salts, ammonium salt, amide compounds and esters; and vinylsulfonic acid, methallylsulfonic acid, 2-acrylamido-2-methylpropanesulfonic acid, p-styrenesulfonic acid and their alkali metal salts and ammonium salts. Among the copolymers of the nitrogen-containing monomers, those having an average molecular weight of 1,000 to 10,000,000 are used.

(c) salts and quaternary ammonium salts of ring-opening polymerization products of ethyleneimine:

They comprise repeating units of the following formula (VI) and have an average molecular weight of 1,000 to 10,000,000:

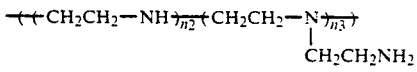

(VI)

wherein $n_2$ represents an integer of 1 to 5 and $n_3$ represents an integer of 0 to 5.

(d) salts and quaternary ammonium salts of polycondensates of an aliphatic dicarboxylic acid with a polyethylenepolyamine or dipolyoxyethylenealkylamine:

They include polycondensates of an aliphatic dicarboxylic acid with a polyethylenepolyamine comprising a recurring unit of the following general formula (VII) or with a dipolyoxyethylenealkylamine comprising a recurring unit of the following general formula (VIII) and having a molecular weight of 1,000 to 10,000,000:

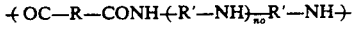

(VII)

wherein R represents a residue of a dimer acid or an alkylene group having 1 to 10 carbon atoms, R' represents $—CH_2CH_2—$ and $n_6$ represents an integer of 2 to 7, and

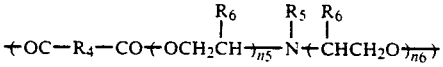

(VII)

wherein R is as defined above, $R_5$ represents an alkyl group having 1 to 8 carbon atoms, $R_6$ represents H or $CH_3$, and $n_5$ and $n_6$ each represents an integer of 1 to 10.

The aliphatic dicarboxylic acids include, for example, dimer acids and adipic acid and the polyethylenepolyamines include, for example, diethylenetriamine and triethylenetetramine.

(e) dihaloalkane/polyalkylenepolyamine polycondensates:

The polycondensates are quaternary ammonium salts of (1) a dihaloalkane such as 1,2-dichloroethane, 1,2-dibromoethane or 1,3-dichloropropane with (2) a polyalkylenepolyamine having two or more tertiary amino groups in the molecule, which salts have an average molecular weight of 1,000 to 10,000,000.

Examples of the polyalkylenepolyamines include the following compounds:

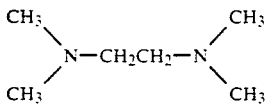

(tetramethylethylenediamine)

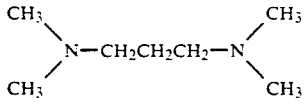

(tetramethylpropylenediamine)

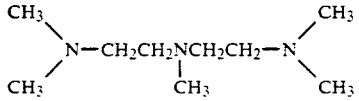

(pentamethyldiethylenetriamine)

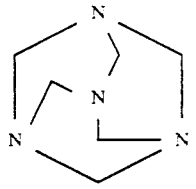

(hexamethylenetetramine)

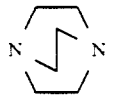

(triethylenediamine)

(f) epihalohydrin/amine polycondensates:
They comprise recurring units of the following general formula (X) and have an average molecular weight of 1,000 to 10,000,000:

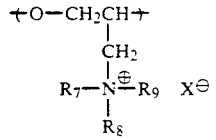

(X)

wherein $R_7$ to $R_9$ each represent an alkyl group having 1 to 4 carbon atoms and $X^{\ominus}$ represents a halogen ion.

Among the polymers (a) to (f), those having an average molecular weight of 10,000 to 1,000,000 are more preferred.

(g) chitosan salts and cation-modified starches and celluloses, (h) cation-modified polyvinyl alcohols, and (i) diallylamine polymers and salts thereof.

The cationic protective colloids of the present invention are not limited to the above-mentioned high molecular substances of types (a) to (i).

The emulsion polymerization reaction according to the present invention may be conducted by suitably mixing the above-mentioned polymerizable monomer(s), catalyst, catalyst activator and polymerization regulator in the presence of the emulsifying dispersant, characterized in that a dry film of the aqueous resin emulsion has a glass transition temperature (Tg) in the range of 20° to 110° C. and a refractive index of 1.50 or less and an emulsion of the aqueous resin composition has a zeta potential in the range of +5 to +80 mV (determined under conditions comprising an ionic strength of $10^{-3}$ and a pH of 7).

When a color deepening agent containing a cationic emulsifying dispersant is used, only the dispersant is adsorbed on the fibers, and a color deepening polymer left in the emulsion is coagulated and, therefore, no color deepening effect can be exhibited and the solution stability of the treating bath is deteriorated.

Such a defect can be prevented by copolymerizing the polymer constituting the color deepening agent with a cationic monomer. By this process, neither rapid coagulation nor deterioration of the stability of the treating bath occurs and the stable color deepening effect can be exhibited even when the emulsifying dispersant is liberated. colloid according to a known process. The emulsion polymerization reaction according to the present invention is conducted by suitably mixing the above-mentioned polymerizable monomer(s), catalyst, catalyst activator and polymerization regulator in the presence of the cationic protective.

The function of the cationic protective colloid can be exhibited not only when it is added in the emulsion polymerization step but also when it is added after completion of the emulsion polymerization conducted in the presence of another emulsifying dispersant.

Although the mixing ratio of the cationic protective colloid to the polymerizable monomer(s) is not particularly limited, it is preferred to use 0.5 to 50 wt. % of the cationic protective colloid and 99.5 to 50 wt. % of the polymerizable monomer(s). More preferably, 2 to 30 wt. % of the former and 98 to 70 wt. % of the latter are used.

Described below is polymerization technique earlier referred to as technique number 4, involving polymerizing a monomer in the presence of a cationic or nonionic emulsifying dispersant so as to have a cationic group in the molecule.

A color deepening agent may also be prepared comprising an aqueous resin emulsion of a cationic high molecular compound having a cationic group in the molecule which compound is a polymer or its derivative prepared by polymerizing a polymerizable monomer having an unsaturated bond, in the presence of a cationic or nonionic emulsifying dispersant, characterized in that a dry film of the aqueous resin emulsion has a glass transition point (Tg) in the range of 20° to 110° C. and a refractive index of 1.50 or less and an emulsion of the aqueous resin composition has a zeta potential in the range of 30 5 to +80 mV (determined under conditions comprising an ionic strength of $10^{-3}$ and a pH of 7).

The emulsifying dispersants that can be used in the polymerization techniques include cationic and nonionic surfactants and cationic and nonionic high-molecular dispersants. Urethane emulsions are excluded since a cloth treated with a urethane emulsion might yellow by exposure to light or heat.

The cationic high-molecular compounds having a suitable cationic group can be prepared by copolymerizing (1) the above-mentioned polymerizable monomer having an unsaturated bond with (2) A polymerizable monomer having an unsaturated and having a cationic group such as a tertiary amino group or a quaternary ammonium group. When the cationic group is a tertiary amino group, the copolymer obtained can be quaternized, if necessary. They can be obtained also by copolymerizing an ethylenically unsaturated monomer having a halogenated methyl group. epoxy group or hydroxyl group with the above-mentioned polymerizable monomer having an unsaturated bond and reacting the obtained copolymer with a tertiary amine, secondary amine (quaternized, if necessary) or quaternizing agent (such as glycidyltrimethylammonium hydrochloride) capable of reacting with the hydroxyl group, respectively.

Examples of the cationic high-molecular compounds having a cationic group include those having a cationic group of the following general formulas (1) or (2):

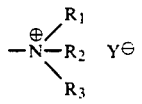

(1)

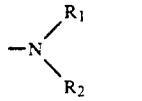

(2)

wherein $R_1$, $R_2$ and $R_3$ may be the same or different and each represent a substituted or unsubstituted alkyl group having 1 to 18 carbon atoms or a hydrogen atom or two of the three groups may be connected together to form a heterocyclic ring such as a pyridyl or imidazolyl group with the adjacent nitrogen atom or two of the three groups may form together a cycloalkyl or heterocycloalkyl group and Y represents a halogen atom or an acid residue.

The above-mentioned cationic group can be introduced easily in the polymer according to the following copolymerization or chemical reaction with the polymer on an industrial scale:

a) quaternization of a polymer prepared by copolymerizing a monomer-selected from the group consisting of monovinylpyridines such as vinylpyridine, 2-methyl-5-vinylpyridine and 2-ethyl-5-vinylpyridine; styrenes having a dialkylamino group, such as N,N-dimethylaminostyrene and N,N-dimethylaminomethylstyrene; acrylates and methacrylates having a dialkylamino group, such as N,N-dimethylaminoethyl methacrylate, N,N-dimethylaminoethyl methacrylate, N,N-dimethylaminoethyl acrylate, N,N-diethylaminoethyl methacrylate, N,N-diethylaminoethyl acrylate, N,N-dimethylaminopropyl methacrylate, N,N-dimethylaminopropyl acrylate, N,N-diethylaminopropyl methacrylate and N,N-diethylaminopropyl acrylate; vinyl ethers having a dialkylamino group, such as 2-dimethylaminoethyl vinyl ether; acrylamides and methacrylamides having a dialkylamino group, such as N-(N',N'-dimethylaminoethyl)methacrylamide, N-(N',N'-dimethylaminoethyl)acrylamide, N-(N',N'-diethylaminoethyl)methacrylamide, N-(N',N'-diethylaminoethyl)acrylamide, N-(N',N'-dimethylaminopropyl) methacrylamide, N-(N',N'-dimethylaminopropyl)acrylamide, N-(N',N'-diethylaminopropyl)methacrylamide and N-(N',N'-diethylaminopropyl)acrylamide, with the abovementioned oleophilic ethylenically unsaturated monomer by a known process with a known quaternizing agent such as an alkyl halide (wherein the alkyl group has 1 to 18 carbon atoms and the halogen is chlorine, bromine or iodine), a benzyl halide, e.g. benzyl bromide, an alkyl ester (wherein the alkyl group has 1 to 18 carbon atoms) of an alkyl- or arylsulfonic acid, e.g. methanesulfonic acid, benzenesulfonic acid or toluenesulfonic acid or a dialkyl sulfate (wherein the alkyl group has 1 to 4 carbon atoms), b) a reaction of (1) a polymer having a halogenated methyl group (—$CH_2X$), such as a copolymer of an ethylenically unsaturated monomer (e.g. chloromethylstyrene, 3-chloro-1-propane, 3-bromo-1-propene, 2-chloroethyl acrylate, 2-chloroethyl methacrylate, 2-bromoethyl acrylate, 2-bromoethyl methacrylate, 3-chloropropyl acrylate, 3-chloropropyl methacrylate, 3-bromopropyl acrylate, 3-bromopropyl methacrylate, 4-chloropropyl acrylate, 4-chloropropyl methacrylate or 2-chloroethyl vinyl ether) with the above-mentioned oleophilic ethylenically unsaturated monomer, chloromethylated polystyrene or a chloromethylated copolymer of styrene with another oleophilic ethylenically unsaturated monomer with (2) an aliphatic tertiary amine such as trimethylamine, triethylamine, tripropylamine, tributylamine, triamylamine, n-octyldimethylamine, n-dodecyldimethylamine or n-tetradecyldimethylamine or an aromatic amine such as dimethylaniline, diethylaniline or tribenzylamine, c) reaction of a polymer, obtained by copolymerizing an ethylenically unsaturated monomer having an epoxy group, such as glycidyl (meth)acrylate, vinyl phenylglycidyl ether, vinylphenylethylene oxide or allyl glycidyl ether with the above-mentioned oleophilic ethylenically unsaturated monomer, with a secondary amine to open the epoxy ring and also to introduce the tertiary amino group thereinto followed by quaternization conducted in the same manner as in the above process a), d) reaction of (1) a polymer having a hydroxyl group, such as a copolymer of an ethylenically unsaturated monomer having a hydroxyl group (such as 2-hydroxyethyl acrylate, 2-hydroxyethyl methacrylate, 2-hydroxypropyl acrylate, 2-hydroxypropyl methacrylate or N-(2-hydroxyethyl)acrylamide) with the above-mentioned oleophilic, ethylenically unsaturated monomer or a saponified copolymer of the above-mentioned oleophilic ethylenically unsaturated monomer with a vinyl alcohol/fatty acid ester with (2) a cationizing agent such as glycidyltrimethylammonium hydrochloride or 3-chloro-2-hydroxypropyltrimethylammonium salt, and e) copolymerization of (1) an ethylenically unsaturated monomer having a cationic group prepared by quaternizing an ethylenically unsaturated monomer having a tertiary amino group as mentioned in the above process a) with a quaternizing agent mentioned in the above process a) or by reacting an ethylenically unsaturated monomer having a chloromethyl group as used in the above process b) with an aliphatic tertiary amine or aromatic amine as used in the above process b) with (2) the above-mentioned oleophilic, ethylenically unsaturated monomer.

It is not always necessary to convert the polymer into its quaternary derivative or salt.

Although the proportion of the cationic monomer to other comonomer(s) is not limited, the amount of the cationic monomer is preferably 0.1 to 95 wt. %, more particularly 1 to 80 wt. %, based on the total polymerizable monomers.

The first unsaturated monomer, having a reactive group to effect a crosslinking reaction and the polymerization catalyst can be used in the same way as described with reference to polymerization technique number 1, which involves polymerization in the presence of a cationic surfactant.

The emulsion polymerization reaction according to the present invention is conducted by suitably mixing the above-mentioned polymerizable monomer(s), catalyst, catalyst activator and polymerization regulator in the presence of the cationic or nonionic emulsifying dispersant according to a known process.

Although the mixing ratio of the cationic or nonionic emulsifying dispersant to the polymerizable monomer(s) is not particularly limited, it is preferred to use 0.5 to 50 wt. % of the cationic or nonionic emulsifying dispersant and 99.5 to 50 wt. % of the polymerizable monomer(s). More preferably, 2 to 30 wt. % of the former and 98 to 70 wt. % of the latter are used.

Among the aqueous resin compositions prepared as describdd above, those constituting the color deepening agent of the present invention are characterized in that dry films prepared from them has a Tg in the range of 20° to 110° C. and a refractive index of 1.50 or less and that an emulsion of the aqueous resin composition has a zeta potential in the range of +5 to +80 mV (determined under conditions comprising an ionic strength of $10^{-3}$ and a pH of 7).

Methods of regulating the Tg, refractive index and zeta potential have not been completely established. The Tg and refractive index can be estimated according to Polymer Handbook. The Tg and Refractive index of a copolymer produced from two or more monomers can be estimated generally according to the following formulae:

a copolymer produced from monomers A, B and C:

$$\text{(i)}\ \frac{1}{Tg \text{ of the copolymer}} = \frac{W_A}{(Tg)_A} + \frac{W_B}{(Tg)_B} + \frac{W_C}{(Tg)_C}$$

wherein $(Tg)_A$, $(Tg)_B$ and $(Tg)_C$ represent the Tg's of homopolymers of A, B and C, respectively and $W_A$, $W_B$ and $W_C$ represent the relative amounts of A, B and C, respectively, in the copolymer.

(ii) refractive index of the copolymer $n = W_A \cdot n_A + W_B n_B + W_C n_C$ wherein $n_A$, $n_B$ and $n_C$ represent the refractive indexes of homopolymers of A, B and C, respectively, and $W_A$, $W_B$ and $W_C$ represent the relative amounts of A, B and C, respectively, in the copolymer The zeta potential of the emulsion can be controlled by changing the amounts of a cationic surfactant, a nonionic substance such as a nonionic surfactant, an inorganic salt and a cationic protective colloid.

By merely immersing the dyed fibers in an aqueous solution of the color deepening agent of the present invention at ambient temperature or by padding the fibers with the latter, the resin can be adsorbed uniformly on the fiber surface By subsequent air drying or heat drying, the resin is fixed on the fibers to improve the deepness and vividness of the color of the dyed fibers.

With the color deepening agent of the present invention, the deepness and vividness of not only the dyed polyester fibers but also dyed fibers of cation-dyeable polyester, polyamide, acrylic, triacetate, rayon, silk, and cotton fibers can be increased.

The color deepening agent of the present invention can be applied to the fibers by the adsorption treatment under ordinary conditions after the dyeing. Further, in case cation-dyeable polyester or acrylic fibers are to be treated, the treatment can be conducted simultaneously with the dyeing. In addition, the adsorption treatment can be conducted before the dyeing.

EXAMPLES

The following examples will further illustrate preparation of a color deepening which by no means limit the invention.

Parts and percentages in the following examples are given by weight, unless otherwise stated.

PREPARATION EXAMPLE 1

3.2 parts (2 parts in terms of solid content) of Quartamin 86P conc. (trademark of stearyltrimethylammonium chloride) available from Kao Corporation, was placed in a 300 ml four-necked flask provided with a nitrogen-inlet tube and a dropping funnel. 71.8 parts of ion-exchanged water was added thereto. The temperature was elevated to 45° C. while air in the reaction system was replaced with nitrogen. Then, 5 parts of isobutyl methacrylate 0.105 part of p-menthane hydroperoxide and 5 parts of a 1 % aqueous solution of sodium formaldehyde sulfoxylate were added successively thereto under stirring to initiate the polymerization. Then, 15 parts of isobutyl methacrylate was added dropwise thereto over 30 min. After completion of the addition of the monomer, the mixture was aged at 50° C. for 2 h to complete the polymerization.

PREPARATION EXAMPLE 2

4 parts of Sanisol C, a trademark of Kao Corporation, for alkylbenzylmethylammonium chloride, was placed in a 300 ml four-necked flask provided with a nitrogen inlet tube and a dropping funnel 71 parts of ion-exchanged water was added thereto The temperature was elevated to 45° C. while air in the reaction system was replaced with nitrogen. Then, 5 parts of isobutyl methacrylate, 0.105 part of p-menthane hydroperoxide and 5 parts of a 1 % aqueous solution of sodium formaldehyde sulfoxylate were added successively thereto under stirring to initiate the polymerization. Then, 15 parts of isobutyl methacrylate was added dropwise thereto over 30 min. After completion of the addition of the monomer, the mixture was aged at 50° C. for 2 h to complete the polymerization.

PREPARATION EXAMPLE 3

8.6 parts (3 parts in terms of solid content) of Kohtamin 24 W (lauryltrimethylammonium chloride of Kao Corporation) and 71.4 parts of water were placed in a 300-m( four-necked flask. The temperature was elevated to 60° C. while air in the reaction system was replaced with nitrogen. 5 parts of methyl methacrylate and then 0.15 part of 2,2'-azobis(2-amidinopropane) hydrochloride were added thereto to initiate the polymerization. 15 parts of methyl methacrylate was added dropwise thereto over 30 min. After completion of the addition of the monomer, the mixture was aged at 60° C. for 1 h to complete the polymerization. No coagulation of the polymer was observed at all in the course of the polymerization and a stable emulsion was obtained.

PREPARATION EXAMPLE 4

6.7 parts (5 parts in terms of solid content) of Kohtamin D-86P (distearyldimethylammonium chloride of Kao Corporation) was placed in a 500-ml four-necked flask provided with a nitrogen inlet tube and a dropping funnel. 233 parts of ion-exchanged water was added thereto. After replacing air in the reaction system with nitrogen thoroughly, 10 parts of trifluoroisopropyl methacrylate was added thereto. The temperature was elevated to 60° C. and 0.105 part of 2,2'-azobis(2-amidinopropane) hydrochloride was added thereto to initiate the polymerization. 90 parts of trifluoroisopropyl methacrylate was added dropwise thereto over 1 h. After completion of the addition of the monomer, the mixture was aged at 60° C. for 1 h, cooled to room temperature and filtered through a 100-mesh metal gauze to remove a coagulum formed in the course of the polymerization. Thus, a stable emulsion utterly free from any smell of the unreacted monomer was obtained.

PREPARATION EXAMPLE 5

7.9 parts (5 parts in terms of solid content) of Kohtamin 86P conc. (stearyltrimethylammonium chloride of Kao Corporation) and 241.8 parts of ionexchanged water were placed in a 500-ml four-necked flask provided with a nitrogen-inlet tube and a dropping funnel and air in the reaction system was replaced thoroughly with nitrogen. 10 parts of propyl methacrylate was added thereto and the temperature was elevated to 60° C. 0.105 part of 2,2'-azobis(2-amidinopropane) hydrochloride was added thereto. 90 parts of propyl methacrylate was added dropwise thereto through a dropping funnel over one hour. After completion of the addition of th monomer, the mixture was aged at 60° C. for 1 h, cooled to room temperature and filtered through a 100-mesh metal gauze to remove a polymer coagulum formed in the course of the polymerization. Thus, a stable emulsion utterly free from any smell of the unreacted monomer was obtained.

PREPARATION EXAMPLE 6

A stable emulsion was prepared by the emulsion polymerization by using 0.15 part of 2,2'-azobis(2amidinopropane) hydrochloride and 245.6 parts of ion-exchanged water, wherein 11.9 parts (7.5 parts in terms of solid content) of Kohtamin 86 P (stearyltrimethylammonium chloride of Kao Corporation), 96 parts of isobutyl methacrylate, 3 parts of N-methylolacrylamide and 1 part of itaconic acid were added dropwise successively in the same manner as in Preparation Example 5.

PREPARATION EXAMPLE 7

A stable emulsion was prepared by the emulsion polymerization by using 0.15 part of 2,2'-azobis(2-amidinopropane) hydrochloride and 245.6 parts of ion-exchanged water, wherein 11.9 parts (7.5 parts in terms of solid content) of Kohtamin 86 P (stearyltrimethylammonium chloride), 96 parts of isobutyl methacrylate, 2 parts of glycidyl methacrylate and 2 parts of methacrylic acid were added dropwise successively in the same manner as in Preparation Example 5.

PREPARATION EXAMPLE 8

COMPARATIVE COLOR DEEPENING AGENT DISCLOSED IN JAPANESE PATENT PUBLICATION NO. 30796/1985

Bisphenol A/propylene oxide adduct (hydroxyl value: 315) was dehydrated at 100° C. under reduced pressure. 115 parts of the dehydrated adduct was placed in a round-bottom flask provided with a thermometer and a stirrer. 87.5 parts of methyl ethyl ketone and 112.5 parts of a mixture of 2,4-tolylene diisocyanate and 2,6-tolylene diisocyanate in a ratio of 80:20 were added thereto and the reaction was conducted at 70° C. for 4 h to obtain a solution of a urethane prepolymer containing 8.36 % of free isocyanato groups.

Separately 487.4 parts of methyl ethyl ketone and 39.1 parts of diethylenetriamine were placed in another flask and the mixture was stirred at 30° to 40° C. for 1 h. 320 parts of the urethane prepolymer solution prepared above was added dropwise to this solution under stirring over 40 min. The mixture was diluted with 162.5 parts of methyl ethyl ketone and the reaction was conducted at 50° C. for 30 min A drop of the reaction solution was subjected to I.R. spectrophotometry. No absorption due to a free isocyanato group at 2250 $cm^{-1}$ was recognized.

101.4 parts of water and 18.3 parts of epichlorohydrin were added to the reaction solution and the reaction was conducted at 50° C. for 1 h 42.8 parts of a 70% aqueous glycolic acid solution and 707 parts of water were added thereto and then methyl ethyl ketone was distilled of at about 40° C. under reduced pressure. Water was added to the residue to adjust the concentration. Thus, a homogeneous, stable polyurethane emulsion having a resin content of 30% was obtained.

An emulsion was prepared by the emulsion polymerization by using 0.15 part of 2,2'-azobis(2- amidinopropane) hydrochloride and 245.6 parts of ion-exchanged water, wherein 25 parts (7.5 parts in terms of solid content) of the polyurethane emulsion prepared above and 100 parts of isobutyl methacrylate were added dropwise successively.

PREPARATION EXAMPLE 9

Comparative Color Deepening Agent

An emulsion was prepared by the emulsion polymerization by using 0.105 part of 2,2'-azobis(2amidinopropane) hydrochloride and 33 parts of ion-exchanged water, wherein 57 parts (20 parts in terms of solid content) of Kohtamin 24W and 10 parts of methyl methacrylate were added dropwise successively.

PREPARATION EXAMPLE 10

Comparative Product 5 parts of Emulgen 935 (polyoxyethylene nonylphenol ether nonionic surfactant of Kao Corporation) and 235 parts of ion-exchanged water were placed in a 500-ml separable four-necked flask provided with a nitrogen gas-inlet tube and the mixture was stirred in nitrogen gas stream to obtain a homogeneous solution. Then, 0.1 part of potassium persulfate and 10 parts of methyl methacrylate were added to the solution and the mixture was heated to 50° C. 10 parts of a 0.5 % aqueous sodium hydrogensulfite solution was added thereto and the mixture was heated to 60° C. 90 parts of methyl methacrylate was added dropwise thereto under stirring over 1 h. After completion of the addition of the monomer, the mixture was aged at 60° C. for 1 h to complete the polymerization and to obtain an emulsion

PREPARATION EXAMPLE 11

Comparative Product

An emulsion was prepared by the emulsion polymerization by using 0.105.part of 2,2'-azobis(2-amidinopropane) hydrochloride and 233 parts of ion-exchanged water, wherein 6.7 parts (5 parts in terms of solid content) of Kohtamin D-86P and 100 parts of benzyl methacrylate were added dropwise successively in the same manner as in Preparation Example 4.

PREPARATION EXAMPLE 12

Comparative Product

An emulsion was prepared by the emulsion polymerization by using 0.105 parts of p-menthane hydroperoxide, 5 parts of a 1 % aqueous solution of sodium formaldehyde sulfoxylate and 71.8 parts of ion-exchanged water, wherein 3.2 parts (2 parts in terms of solid content) of Kohtamin 86P and 20 parts of butyl acrylate were added dropwise successively in the same manner as in preparation Example 1.

The compositions of the products prepared in Preparation Examples 1 to 12 and the physical properties of them are shown in Table 6.

Evaluation

1) Color deepening effect:

The color deepening effect was examined by means of a color machine (a product of Suga Test Instruments Co., Ltd.) to determine L, a and b values. The lower the L value, the lower is the lightness and the deeper is the color.

2) Yellowing:

The yellowing was determined from a difference (Δb) in the b value [(b value after the exposure) (b value before the exposure)] determined with the color machine before and after the exposure. The larger the Δb, the higher is the degree of yellowing.

TABLE 1

| Color deepening agent | | Color deepening effect (L-value) | | Yellowing by light | | |
|---|---|---|---|---|---|---|
| | | padding-drying-curing process | immersion process | b value before exposure | b value after exposure | Δb |
| Polymerization Technique 1 | Prep. Ex. 1 | 12.7 | 12.8 | 0.3 | 0.4 | 0.1 |
| | Prep. Ex. 2 | 12.6 | 12.7 | 0.3 | 0.5 | 0.2 |
| Comparative Preparation | Prep. Ex. 8 | 12.7 | 13.5 | 0.5 | 1.7 | 1.2 |
| | (treatment with water) | 14.5 | 14.5 | 0.2 | 0.3 | 0.1 |

EXAMPLE 1 Yellowing of a Cloth Treated with Color Deepening Agent

A polyester cloth dyed black was treated with an aqueous resin composition prepared in the above preparation examples to evaluate the color deepening effect of the composition. Then, the cloth thus treated with the color deepening agent (cloth subjected to padding-drying-curing treatment) was exposed to a light with a weatherometer (light source carbon arc, a product of Suga Test Instruments Co., Ltd.) for 80 h to examine the yellowing by light. The results are shown in Table 1.

Treatment Conditions

1) Padding-drying-curing process:

A bath containing 6 g (in terms of solid content)/l of the color deepening agent shown in Table 2 was prepared. After padding the cloth while the temperature was kept at ambient temperature to 30° C, the cloth was squeezed to a liquid content of 100 %, dried at 100° C. for 3 h and cured at 180° C. for 1 min.

2) Immersion-dehydration-air drying process:

A bath containing 0.5 g (in terms of solid content)/l of the color deepening agent shown in Table 1 was prepared The cloth was stirred in the bath (bath ratio: 1/10) at ambient temperature for 10 min to conduct uniform adsorption The cloth was dehydrated by centrifugation to a liquid content of 80% and then air-dried at ambient temperature.

The color deepening agents of the present invention exhibited excellent color deepening effects in both of the padding-drying-curing process and immersion-air drying process. They were scarcely yellowed by the exposure to the light for 80 h. On the other hand, the color deepening agent prepared in Preparation Example 8 using the urethane emulsion as a protective colloid exhibited an insufficient color deepening effect in the immersion-air-drying process, though it exhibited an excellent color deepening effect in the padding-drying-curing process.

EXAMPLE 2

Zeta Potential and Color-deepening effect of emulsion

A polyester cloth dyed in black and a silk cloth dyed in blank were treated with an aqueous resin composition shown in Table 2 by the padding-drying-curing process to evaluate the color deepening effect of the composition.

The zeta potential of the aqueous resin composition emulsion was determined with a zeta meter.

| (Measurement conditions) | |
|---|---|
| aqueous resin composition emulsion | 1 g/l (in terms of solid content) |
| ionic strength | $10^{-3}$ |
| pH | 7 |

The results are shown in Table 2.

TABLE 2

| Color deepening agent | | Color deepening effect (L-value) | | Physical properties | | |
|---|---|---|---|---|---|---|
| | | Polyester | Silk | zeta potential (mV) | refractive index | Tg (°C.) |
| Polymerization Technique | Prep. Ex. 3 | 13.8 | 12.3 | 40 | 1.46 | 98 |
| Comparative Preparation | Prep. Ex. 9 | 14.3 | 13.5 | 97 | 1.49 | 89 |
| | Prep. Ex. 10 | 14.8 | 14.0 | −10 | 1.47 | 102 |
| | (treatment with water) | 15.0 | 14.3 | — | — | — |

Although the refractive indexes and Tg in Preparation Examples 3, 9 and 10 were the same, an excellent color deepening effect was obtained in only Preparation example 3.

It is considered that the product of Preparation Example 9 could not be adsorbed on the fibers, since it had a zeta potential of as high as 97 mV and it was quite stable in water. Supposedly, the product of Preparation Example 10 having the same negative electric potential as that of the fiber surface could not be adsorbed on the fibers due to electrostatic repulsion.

EXAMPLE 3

Refractive Index and Color Deepening Effect

An acrylic cloth dyed in black was treated with an aqueous resin composition shown in Table 3 according to the immersion-air drying process to evaluate the color deepening effect of the composition. The aqueous resin composition sample was dried to form a film and the refractive index of the film was determined with a refractometer The results are shown in Table 3

TABLE 3

| Color deepening agent | | Color deepening effect (L-value) | Physical properties: refractive index | zeta potential (mV) | Tg (°C.) |
|---|---|---|---|---|---|
| Polymerization Technique 1 | Prep. Ex. 1 | 13.3 | 1.47 | 38 | 49 |
| | Prep. Ex. 4 | 13.0 | 1.42 | 23 | 73 |
| Comparative Preparation | Prep. Ex. 11 | 14.7 | 1.57 | 25 | 48 |
| | (treatment with water) | 14.8 | — | — | — |

The color deepening agents of the present invention exhibited an excellent color deepening effect, while that prepared in Prep. Ex. 11 and having a high refractive index exhibited no effect of deepening the color.

EXAMPLE 4

Tg and Color Deepening Effect

A cotton cloth and wool cloth both dyed in black were treated with an aqueous resin composition shown in Table 4 according to the padding-drying-curing process to evaluate the color-deepening effect of the composition Only in the treatment of the wool cloth, 4% of isopropyl alcohol was added as a penetrant to the bath.

The aqueous resin composition was dried and Tg thereof was determined according to the DSC method. The results are shown in Table 4

TABLE 4

| Color deepening agent | | Color deepening effect (L-value): cotton | wool | Physical properties: Tg (°C.) | zeta potential (mV) | refractive index |
|---|---|---|---|---|---|---|
| Polymerization Technique 1 | Prep. Ex. 3 | 13.1 | 12.7 | 98 | 40 | 1.46 |
| | Prep. Ex. 5 | 13.0 | 12.8 | 25 | 39 | 1.47 |
| Comparative Preparation | Prep. Ex. 12 | 14.2 | 13.9 | −47 | 37 | 1.47 |
| | (treatment with water) | 14.5 | 14.0 | — | — | — |

Both of the color deepening agents of the present invention exhibited an excellent color-deepening effect. The color deepening agent prepared in Preparation Example 12 exhibited no effect of deepening the color, since its Tg was too low.

It is apparent from Examples 2 to 4 that the excellent color deepening effect cannot be obtained unless all of the zeta potential, refractive index and Tg properties of the color deepening agents are optimum.

EXAMPLE 5

Crosslinkable Group and Color Deepening

A polyester cloth dyed in black and that dyed in red were treated with an aqueous resin composition shown in Table 6 according to the padding-drying-curing process to evaluate the color-deepening effect of the composition.

The color-deepening effect of the red cloth was evaluated according to the values a and b, i.e. saturation $\sqrt{a^2+b^2}$. The higher the value of $\sqrt{a^2+b^2}$, the deeper and more vivid the color. The results are shown in Table 5.

TABLE 5

| Color deepening agent | | L value of cloth dyed in black | $\sqrt{a^2+b^2}$ of cloth dyed in red |
|---|---|---|---|
| Polymerization Technique 1 | Prep. Ex. 1 | 13.0 | 49.8 |
| | Prep. Ex. 2 | 13.2 | 49.6 |
| | Prep. Ex. 6 | 12.7 | 52.3 |
| | Prep. Ex. 7 | 12.6 | 52.0 |
| Comparative Preparation | Prep. Ex. 8 | 13.6 | 48.8 |
| | (treatment with water) | 15.1 | 48.2 |

All of the color deepening agents of the present invention exhibited an excellent color deepening effect.

TABLE 6

| Color deepening agent | | Emulsifying dispersant | Monomers | Zeta potential (mV) | Refractive index | Tg (°C.) |
|---|---|---|---|---|---|---|
| Polymerization Technique 1 | Prep. Ex. 1 | Kohtamin 86P | isobutyl methacrylate | 38 | 1.47 | 49 |
| | Prep. Ex. 2 | Sanizol C | isobutyl methacrylate | 30 | 1.47 | 49 |

TABLE 6-continued

| Color deepening agent | | Emulsifying dispersant | Monomers | Zeta potential (mV) | Refractive index | Tg (°C.) |
|---|---|---|---|---|---|---|
| | Prep. Ex. 3 | Kohtamin 24W | methyl methacrylate | 40 | 1.46 | 98 |
| | Prep. Ex. 4 | Kohtamin D86P | trifluoroisopropyl methacrylate | 23 | 1.42 | 73 |
| | Prep. Ex. 5 | Kohtamin 86P | propyl methacrylate | 39 | 1.47 | 25 |
| | Prep. Ex. 6 | Kohtamin 86P | isobutyl methacrylate/N-methylolacrylamide/itaconic acid | 39 | 1.46 | 52 |
| | Prep. Ex. 7 | Kohtamin 86P | isobutyl methacrylate/glycidyl methacrylate/methacrylic acid | 37 | 1.47 | 52 |
| Comparative Preparation | Prep. Ex. 8 | urethane emulsion | isobutyl methacrylate | 23 | 1.46 | 52 |
| | Prep. Ex. 9 | Kohtamin 24W | methyl methacrylate | 97 | 1.49 | 89 |
| | Prep. Ex. 10 | Emulgen 935 | methyl methacrylate | −10 | 1.47 | 102 |
| | Prep. Ex. 11 | Kohtamin D86P | benzyl methacrylate | 25 | 1.57 | 48 |
| | Prep. Ex. 12 | Kohtamin 86P | butyl acrylatw | 37 | 1.47 | −47 |

Among them, those prepared by the copolymerization with monomers having a crosslinkable group in Preparation Examples 6 and 7 exhibited a particularly excellent color deepening effect.

The invention will be further described below in respect to the emulsion obtained by polymerization techniques number 2 and 3, involving, respectively, cationic protective colloids and cationic protective colloids in the presence of an emulsifying dispersant.

The following high-molecular dispersants were prepared as the protective colloids to be used in the present invention:

A: polymer of a quaternary ammonium salt of dimethylaminopropylmethacrylamide with methyl chloride ($\overline{MW}$: 800,000), B: copolymer of dimethylaminoethyl methacrylate neutralized with glycolic acid / sodium acrylate (6/1) ($\overline{MW}$: 500,000)

C: copolymer of quaternary ammonium salt of vinylpyridine with dimethyl sulfate/vinylpyrophosphoric acid/sodium acrylate (6/3/1) ($\overline{MW}$: 450,000), D: copolymer of dimethylaminoethyl methacrylate neutralized with glycolic acid/sodium 2-acrylamido-2-methylpropanesulfonate (4/1) ($\overline{MW}$: 100,000), E: polyethyleneimine neutralized with phosphoric acid ($\overline{MW}$: 70,000

F: quaternary ammonium salt of cation-modified cellulose ($\overline{MW}$: 1,000,000)

G: 1,2-dichloroethane/hexamethylenetetramine polycondensate ($\overline{MW}$: 50,000), H: dimer acid/diethylenetriamine polycondensate neutralized with phosphoric acid ($\overline{MW}$: 800,000), and I: ring-opening polymerization product of epichlorohydrin quaternize with trimethylamine ($\overline{MW}$: 15,000).

In the following preparation examples, color deepening agents were prepared with the above-mentioned high molecular dispersants (solid content: 20%).

PREPARATION EXAMPLE 13

10 parts (2 parts in terms of solid content) of the high molecular dispersant A was placed in a 300-ml four-necked flask provided with a nitrogen-inlet tube and a dropping funnel. 65 parts of ion-exchanged water was added thereto. The temperature was elevated to 45° C. while air in the reaction system was replaced with nitrogen. Then, 5 parts of isobutyl methacrylate, 0.105 part of p-menthane hydroperoxide and 5 parts of a 1% aqueous solution of sodium formaldehyde sulfoxylate were added successively thereto under stirring to initiate the polymerization. Then, 15 parts of isobutyl methacrylate was added dropwise thereto over 30 min. After completion of the addition of the monomer, the mixture was aged at 50° C. for 2 h to complete the polymerization and to obtain an emulsion.

PREPARATION EXAMPLE 14

A stable emulsion was prepared by the emulsion polymerization by using 0.105 part of p-menthane hydroperoxide, 5 parts of a 1% aqueous solution of sodium formaldehyde sulfoxylate and 65 parts of ion-exchanged water, wherein 10 parts (2 parts in terms of solid content) of the high-molecular dispersant B and 20 parts of isobutyl methacrylate were added dropwise successively in the same manner as in Preparation Example 13.

PREPARATION EXAMPLE 15

A stable emulsion was prepared by the emulsion polymerization by using 0.105 part of 2,2'-azobis(2-amidinopropane) hydrochloride and 70 parts of ion-exchanged water, wherein 15 parts (3 parts in terms of solid content) of the high molecular dispersant C and 15 parts of isobutyl methacrylate were added dropwise successively in the same manner as in Preparation Example 13.

PREPARATION EXAMPLE 16

A stable emulsion was prepared by the emulsion polymerization by using 0.105 part of 2,2'-azobis(2-amidinopropane) hydrochloride and 70 parts of ion-exchanged water, wherein 15 parts (3 parts in terms of solid content) of the high molecular dispersant D and 15 parts of isobutyl methacrylate were added dropwise successively in the same manner as in Preparation Example 13.

PREPARATION EXAMPLE 17

30 parts (6 parts in terms of solid content) of the high-molecular dispersant E was placed in a 500-ml four-necked flask provided with a nitrogen inlet tube and a dropping funnel. 233 parts of ion-exchanged water was added thereto. After replacing air in the reaction system with nitrogen thoroughly, 10 parts of trifluoroisopropyl methacrylate was added thereto. The temperature was elevated to 60° C. and 0.105 part of 2,2'-azobis(2-amidinopropane) hydrochloride was added thereto to initiate the polymerization. 90 parts of trifluoroisopropyl methacrylate was added dropwise thereto over 1 h. After completion of the addition of the monomer, the mixture was aged at 60° C. for 1 h, cooled to room temperature and filtered through a 100-mesh metal gauze to remove a coagulum formed in the course of the polymerization. Thus, a stable emulsion utterly free from any smell of the unreacted monomer was obtained.

PREPARATION EXAMPLE 18

A stable emulsion was prepared by the emulsion polymerization by using 0.105 part of 2,2'-azobis(2-amidinopropane) hydrochloride and 233 parts of ion-exchanged water, wherein 30 parts (6 parts in terms of solid content) of the high-molecular dispersant F and 100 parts of trifluoroisopropyl methacrylate were added dropwise successively in the same manner as in Preparation Example 17.

PREPARATION EXAMPLE 19

A stable emulsion was prepared by the emulsion polymerization by using 0.105 part of 2,2'-azobis(2-amidinopropane) hydrochloride and 233 parts of ion-exchanged water, wherein 40 parts (8 parts in terms of solid content) of the high molecular dispersant G and 100 parts of methyl methacrylate were added dropwise successively in the same manner as in Preparation Example 17.

PREPARATION EXAMPLE 20

A stable emulsion was prepared by the emulsion polymerization by using 0.105 part of 2,2'-azobis(2-amidinopropane) hydrochloride and 233 parts of ion-exchanged water, wherein 40 parts (8 parts in terms of solid content) of the high-molecular dispersant H and 100 parts of methyl methacrylate were added dropwise successively in the same manner as in Preparation Example 17.

PREPARATION EXAMPLE 21

A stable emulsion was prepared by the emulsion polymerization by using 0.105 part of p-menthane hydroperoxide, 5 parts of a 1% aqueous solution of sodium formaldehyde sulfoxylate and 65 parts of ion-exchanged water, wherein 10 parts (2 parts in terms of solid content) of the high-molecular dispersant I and 20 parts of propyl methacrylate were added dropwise successively in the same manner as in Preparation Example 13.

PREPARATION EXAMPLE 22

5 parts of Emulgen 935 (polyoxyethylene nonylphenol ether nonionic surfactant of Kao Corporation) and 235 parts of ion-exchanged water were placed in a 500-ml separable four-necked flask provided with a nitrogen gas-inlet tube and the mixture was stirred in nitrogen gas stream to obtain a homogeneous solution. Then, 0.1 part of potassium persulfate and 10 parts of methyl methacrylate were added to the solution and the mixture was heated to 50° C. 10 parts of a 0.5% aqueous sodium hydrogensulfite solution was added thereto and the mixture was heated to 60° C. 90 parts of methyl methacrylate was added dropwise thereto under stirring over 1 h. After completion of the addition of the monomer, the mixture was aged at 60° C. for 1 h to complete the polymerization and to obtain an emulsion.

20 parts (4 parts in terms of solid content) of the high-molecular dispersant A was added to 100 parts of the obtained nonionic emulsion to obtain a cationic emulsion.

PREPARATION EXAMPLE 23

A nonionic emulsion of methyl methacrylate was prepared in the same manner as in Preparation Example 22. 30 parts (6 parts in terms of solid content) of the high-molecular dispersant F was added to 100 parts of the emulsion to obtain a cationic emulsion.

PREPARATION EXAMPLE 24

A stable emulsion was prepared by the emulsion polymerization by using 0.15 part of 2,2'-azobis(2-amidinopropane) hydrochloride and 205 parts of ion-exchanged water, wherein 50 parts (10 parts in terms of solid content) of the high-molecular dispersant B, 96 parts of isobutyl methacrylate, 3 parts of N-methylolacrylamide and 1 part of itaconic acid were added dropwise successively in the same manner as in Preparation Example 17.

PREPARATION EXAMPLE 25

A stable emulsion was prepared by the emulsion polymerization by using 0.15 part of 2,2'-azobis-(2-amidinopropane) hydrochloride and 205 parts of ion-exchanged water, wherein 50 parts (10 parts in terms of solid content) of the high-molecular dispersant D, 96 parts of isobutyl methacrylate, 2 parts of glycidyl methacrylate and 2 parts of methacrylic acid were added dropwise successively in the same manner as in Preparation Example 17.

PREPARATION EXAMPLE 26

Comparative Color Deepening

An emulsion was prepared by the emulsion polymerization by using 0.105 part of 2,2'-azobis(2-amidinopropane) hydrochloride and 20 parts of ion-exchanged water, wherein 70 parts (14 parts in terms of solid content) of the high-molecular dispersant G and 10 parts of methyl methacrylate were added dropwise successively according to Preparation Example 17.

PREPARATION EXAMPLE 27

Comparative Product

An emulsion was prepared by the emulsion polymerization by using 0.105 part of 2,2'-azobis(2-amidinopropane) hydrochloride and 233 parts of ion-exchanged water, wherein 25 parts (5 parts in terms of solid content) of the highmolecular dispersant H and 100 parts of benzyl methacrylate were added dropwise successively in the same manner as in Preparation Example 17.

PREPARATION EXAMPLE 28

Comparative Product

An emulsion was prepared by the emulsion polymerization by using 0.105 part of p-menthane hydroperoxide, 5 parts of a 1% aqueous solution of sodium formaldehide dye sulfoxylate and 71.8 parts of ion-exchanged water, wherein 10 parts (2 parts in terms of solid content) of the high-molecular dispersant I and 20 parts of butyl acrylate were added dropwise successively in the same manner as in Preparation Example 13.

The compositions of the products prepared in Preparation Examples 13 to 28 and the physical properties of them are shown in Table 7.

TABLE 7

| Color deepening agent | | Emulsifying dispersant | Monomers | Zeta potential (mV) | Refractive index | Tg (°C.) |
|---|---|---|---|---|---|---|
| Polymerization Technique 2 | Prep. Ex. 13 | A | isobutyl methacrylate | 58 | 1.47 | 49 |
| | Prep. Ex. 14 | B | isobutyl methacrylate | 35 | 1.47 | 50 |
| | Prep. Ex. 15 | C | isobutyl methacrylate | 42 | 1.48 | 51 |
| | Prep. Ex. 16 | D | isobutyl methacrylate | 52 | 1.47 | 49 |
| | Prep. Ex. 17 | E | trifluoroisopropyl methacrylate | 48 | 1.43 | 73 |
| | Prep. Ex. 18 | F | trifluoroisopropyl methacrylate | 33 | 1.42 | 75 |
| | Prep. Ex. 19 | G | methyl methacrylate | 20 | 1.47 | 97 |
| | Prep. Ex. 20 | H | methyl methacrylate | 57 | 1.48 | 95 |
| | Prep. Ex. 21 | I | propyl methacrylate | 32 | 1.47 | 25 |
| Polymerization Technique 3 | Prep. Ex. 22 | Emulgen 935→A | methyl methacrylate | 39 | 1.46 | 88 |
| | Prep. Ex. 23 | Emulgen 935→F | methyl methacrylate | 27 | 1.47 | 89 |
| Polymerization Technique 2 | Prep. Ex. 24 | B | isobutyl methacrylate/N-methylolacrylamide/ itaconic acid | 37 | 1.47 | 51 |
| | Prep. Ex. 25 | D | isobutyl methacrylate/glycidyl methacrylate/methacrylic acid | 51 | 1.47 | 50 |
| Comparative | Prep. Ex. 26 | G | methyl methacrylate | 97 | 1.47 | 94 |
| | Prep. Ex. 27 | H | benzyl methacrylate | 52 | 1.57 | 48 |
| | Prep. Ex. 28 | I | butyl acrylate | 30 | 1.47 | −47 |

Examples 6 to 10 were conducted in the same way as shown in Examples 1 to 5, respectively, using color-deeping agents listed in Tables. Results are shown in Tables.

EXAMPLE 6

Yellowing of a Cloth Treated with Color Deepening Agent

TABLE 8

| Color deepening agent | | Color deepening effect (L-value) | | Yellowing by light | | |
|---|---|---|---|---|---|---|
| | | Padding-drying-curing process | immersion process | b value before exposure | b value after exposure | $\Delta_b$ |
| Polymerization Technique 2 | Prep. Ex. 13 | 12.8 | 12.9 | 0.4 | 0.6 | 0.2 |
| | Prep. Ex. 14 | 12.7 | 12.8 | 0.4 | 0.5 | 0.1 |
| | Prep. Ex. 15 | 12.7 | 12.8 | 0.3 | 0.5 | 0.2 |
| | Prep. Ex. 16 | 12.8 | 12.8 | 0.4 | 0.6 | 0.2 |
| Comparative Preparation | Prep. Ex. 8 | 12.8 | 13.8 | 0.5 | 1.7 | 1.2 |
| | (treatment with water) | 14.7 | 14.7 | 0.3 | 0.5 | 0.2 |

The color deepening agents of the present invention exhibited excellent color deepening effects in both of the padding-drying-curing process and immersion-air drying process. They were scarcely yellowed by the exposure to the li9ht for 80 h. On the other hand, the color deepening agent prepared in Preparation Eample 8 using the urethane emulsion as protective colloid exhibited an insufficient color deepening effect in the immersion-air-drying process, though it exhibited an excellent color deepening effect in the padding-drying-curing process.

EXAMPLE 7

Zeta Potential and Color-deepening Effect of Emulsion

TABLE 9

| Color deepening agent | | Color deepening effect (L-value) | | Physical properties | | |
|---|---|---|---|---|---|---|
| | | polyester | silk | zeta potential (mV) | refractive index | Tg (°C.) |
| Polymerization Technique 2 | Prep. Ex. 19 | 13.5 | 12.2 | 20 | 1.47 | 97 |
| | Prep. Ex. 20 | 13.3 | 12.0 | 57 | 1.48 | 95 |
| Comparative Preparation | Prep. Ex. 26 | 14.2 | 13.5 | 97 | 1.47 | 94 |
| | Prep. Ex. 10 | 14.8 | 13.9 | −10 | 1.47 | 90 |
| | (treatment with water) | 15.2 | 14.2 | — | — | — |

Although the refractive indexes and Tg in Preparation Examples 19, 20, 26 and 10 were substantially the same, the color deepening effect of Preparation Examples 19 and 20, according to the present invention, was quite excellent.

It is considered that the product of Preparation Example 15 could not be adsorbed on the fibers, since it had a zeta potential of as high as 97 mV and it as quite stable in water. Supposedly, the product of Preparation Example 10 having the same negative electric potential as that of the fiber surface could not be adsorbed on the fibers due to electrostatic repulsion.

EXAMPLE 8

Refractive Index and Color Deepening

TABLE 10

| Color deepening agent | | Color deepening effect (L-value) | Physical properties: refractive index | zeta potential (mV) | Tg (°C.) |
|---|---|---|---|---|---|
| Polymerization Technique 2 | Prep. Ex. 13 | 12.6 | 1.47 | 58 | 49 |
| | Prep. Ex. 16 | 12.7 | 1.47 | 52 | 49 |
| | Prep. Ex. 17 | 12.4 | 1.43 | 48 | 73 |
| | Prep. Ex. 18 | 12.5 | 1.42 | 33 | 75 |
| Comparative Preparation | Prep. Ex. 27 | 14.4 | 1.57 | 52 | 48 |
| | (treatment with water) | 14.7 | — | — | — |

The color deepening agents of the present invention prepared in Preparation Examples 13, 16, 17 and 18 exhibited an excellent color deepening effect, while that prepared in Prep. Ex. 27 and having a high refractive index exhibited no effect of deepening the color.

EXAMPLE 9

Tg and Color Deepening Effect

TABLE 11

| Color deepening agent | | Color deepening effect (L-value): cotton | wool | Physical properties: Tg (°C.) | zeta potential (mV) | refractive index |
|---|---|---|---|---|---|---|
| Polymerization Technique 2 | Prep. Ex. 14 | 13.0 | 12.3 | 52 | 35 | 1.47 |
| | Prep. Ex. 20 | 12.9 | 12.2 | 95 | 57 | 1.48 |
| | Prep. Ex. 21 | 13.1 | 12.5 | 25 | 32 | 1.47 |
| Comparative Preparation | Prep. Ex. 28 | 14.1 | 13.8 | −47 | 30 | 1.47 |
| | (treatment with water) | 14.5 | 14.0 | — | — | — |

All of the color deepening agents of the present invention exhibited an excellent color-deepening effect. The color deepening agent prepared in Preparation Example 28 exhibited no effect of deepening the color, since its Tg was too low.

It is apparent from Examples 7 to 9 that the excellent color deepening effect cannot be obtained unless all of the zeta potential, refractive index and Tg of the color deepening agents are optimum.

EXAMPLE 10

Crosslinkable Group and Color Deepening Effect

TABLE 12

| Color deepening agent | | L value of cloth dyed in black | $\sqrt{a^2 + b^2}$ of cloth dyed in red |
|---|---|---|---|
| Polymerization Technique 2 | Prep. Ex. 14 | 13.3 | 49.8 |
| | Prep. Ex. 16 | 13.2 | 50.0 |
| | Prep. Ex. 24 | 12.5 | 52.2 |
| | Prep. Ex. 25 | 12.6 | 52.1 |
| Comparative Preparation | Prep. Ex. 8 | 13.5 | 48.8 |
| | (treatment with water) | 15.0 | 48.2 |

All of the color deepening agents of the present invention exhibited an excellent color deepening effect. Among them, those prepared by the copolymerization with monomers having a crosslinkable group in Preparation Examples 24 and 25 exhibited a particularly excellent color deepening effect.

EXAMPLE 11

Addition of Protective Colloid After Emulsion

Polymerization

A polyester cloth dyed in black was treated with an aqueous resin composition shown in Table 13 by the padding-drying-curing process or immersion-air drying process and the color deepening effect of the composition was evaluated. The results are shown in Table 13

TABLE 13

| Color deepening agent | | Color deepening effect (L-value): padding-drying-curing process | immersion-air drying process |
|---|---|---|---|
| Polymerization Technique 3 | Prep. Ex. 22 (A. added after dyeing) | 13.4 | 13.2 |
| | Prep. Ex. 22 (A. added after dyeing) | 13.6 | 13.3 |
| Comparative Preparation | Prep. Ex. 10 (no color deepening agent) | 14.8 | 15.0 |
| | (treatment with water) | 15.2 | 15.2 |

The products of the present invention prepared by adding the high-molecular dispersant after the emulsion polymerization exhibited a remarkable color-deepening effect, while the product of Preparation Example 10 in which the emulsion polymerization was conducted in the presence of Emulgen 935 (a nonionic surfactant) scarcely exhibited any color-deepening effect. This fact suggests that even when the high-molecular dispersant was added after completion of the emulsion polymerization, it acts as the protective colloid for the color deepening agent to accelerate the adsorption thereof on the fibers.

The invention will be explained below with reference to examples using polymerization technique number 4 involving a cationic or nonionic emulsifying dispersant so as to have a cationic group in the molecule.

PREPARATION EXAMPLE 29

3.2 parts (2 parts in terms of solid content) of Kohtamin 86 P conc. (stearyltrimethylammonium chloride of Kao Corporation) was placed in a 300-ml four-necked flask provided with a nitrogen-inlet tube and a dropping funnel 71.8 parts of ion-exchanged water was added thereto. The temperature was elevated to 45° C. while air in the reaction system was replaced with nitrogen Then, 2 parts of isobutyl methacrylate, 3 parts of 2-methyl-5-vinylpyridine, 0.105 part of p-menthane hydroperox ide and 5 parts of a 1% aqueous solution of sodium formaldehyde sulfoxylate were added successively thereto under stirring to initiate the polymerization. Then, 15 parts of isobutyl methacrylate was added dropwise thereto over 30 min. After completion of the addition of the monomer, the mixture was aged at 50° C. for 2 h and finally, the product was quaternized with diethyl sulfate to obtain an emulsion

PREPARATION EXAMPLE 30

A stable emulsion was prepared by the emulsion polymerization by using 0.105 part of p-menthane hydroperoxide, 5 parts of a 1% aqueous solution of sodium formaldehyde sulfoxylate and 71.8 parts of ion-exchanged water, wherein 3.2 parts (2 parts in terms of solid content) of Kohtamin 86P conc., 15 parts of isobutyl methacrylate and 5 parts of N,N-dimethylaminoethyl methacrylate were added dropwise successively in the same manner as in Preparation Example 29.

PREPARATION EXAMPLE 31

A stable emulsion was prepared by the emulsion polymerization by using 0.105 part of p-menthane hydroperoxide, 5 parts of a 1% aqueous solution of sodium formaldehyde sulfoxylate and 71.8 parts of ion-exchanged water, wherein 3.2 parts (2 parts in terms of solid content) of Kohtamin 86P conc., 15 parts of propyl methacrylate and 5 parts of 2-dimethylaminoethyl vinyl ether were added dropwise successively in the same manner as in Preparation Example 29 and finally the product was quaternized with benzyl chloride.

PREPARATION EXAMPLE 32

5 parts of Emulgen 935 (a nonionic polyoxyethylene nonylphenyl ether surfactant of Kao Corporation) was placed in a 500-ml four-necked flask provided with a nitrogen inlet tube and a dropping funnel 233 parts of ion-exchanged water was added thereto. Air in the reaction system was replaced thoroughly with nitrogen. 10 parts of trifluoroisopropyl methacrylate and 20 parts of N-(N',N'-diethylaminoethyl)-methacrylamide were added thereto and the temperature was elevated to 60° C. 0.105 part of 2,2'-azobis(2-amidinopropane) hydrochloride was added thereto to initiate the polymerization reaction. Then 70 parts of trifluoroisopropyl methacrylate was added dropwise thereto over 1 h. After completion of the addition of the monomer, the mixture was aged at 60° C. for 1 h. The product was quaternized with dimethyl sulfate to obtain a stable emulsion.

PREPARATION EXAMPLE 33

A stable emulsion was prepared by the emulsion polymerization by using 0.105 part of 2,2'-azobis(2-amidinopropane) hydrochloride and 233 parts of ion-exchanged water, wherein 5 parts of Emulgen 935, 80 parts of trifluoroisopropyl methacrylate and 20 parts of a reaction product of 2-bromoethyl methacrylate and trimethylamine were added dropwise successively in the same manner as in Preparation Example 32.

PREPARATION EXAMPLE 34

A stable emulsion was prepared by the emulsion polymerization by using 0.105 part of 2,2'-azobis (2-amidinopropane) hydrochloride and 233 parts of ion-exchanged water, wherein 10 parts of JR-400 (a cationized cellulose of Union Carbide Corp.), 80 parts of methyl methacrylate and 10 parts of glycidyl methacrylate were added dropwise successively and then the product was quaternized with diethyl sulfate in the same manner as in Preparation Example 32.

PREPARATION EXAMPLE 35

A stable emulsion was prepared by the emulsion polymerization by using 0.105 part of 2,2'-azobis (2-amidinopropane) hydrochloride and 233 parts of ion-exchanged water, wherein 10 parts of JR-400, 70 parts of methyl methacrylate and 20 parts of a reaction product of 2-hydroxyethyl acrylate and 3-chloro-2-hydroxypropyltrimethylammonium salt were added dropwise successively in the same manner as in Preparation Example 32.

PREPARATION EXAMPLE 36

A stable emulsion was prepared by the emulsion polymerization by using 0.15 part of 2,2'-azobis(2-amidinopropane) hydrochloride and 245.6 parts of ion-exchanged water, wherein 11.9 parts (7.5 parts in terms of solid content) of Kohtamin 86P conc., 86 parts of isobutyl methacrylate, 3 parts of N-methylolacrylamide, 10 parts of 2-methyl-5-vinylpyridine quaternized with benzyl chloride and 1 part of itaconic acid were added dropwise successively in the same manner as in Preparation Example 32.

PREPARATION EXAMPLE 37

A stable emulsion was prepared by the emulsion polymerization by using 0.105 part of 2,2'-azobis(2 amidinopropane) hydrochloride and 245.6 parts of ion-exchanged water, wherein 11.9 parts (7.5 parts in terms of solid content) of Kohtamin 86P conc., 76 parts of isobutyl methacrylate, 20 parts of 2.dimethylaminoethyl vinyl ether, 2 parts of glycidyl methacrylate and 2 parts of methacrylic acid were added dropwise successively in the same manner as in Preparation Example 32.

PREPARATION EXAMPLE 38

Comparative Color Deepening Agent

An emulsion was prepared by the emulsion polymerization by using 0.105 part of p-menthane hydroperoxide, 5 parts of sodium formaldehyde sulfoxylate and 33 parts of ion-exchanged water, wherein 57 parts (20 parts in terms of solid content) of Kohtamin 86P conc., 7 parts of isobutyl methacrylate and 3 parts of N,N-dimethylaminoethyl methacrylate were added dropwise successively in the same manner as in Preparation Example 29.

PREPARATION EXAMPLE 39

Comparative Product 5 parts of Emulgen 935 was placed in a 500-ml four-necked flask provided with a nitrogen-inlet tube and a dropping funnel. 233 parts of ion-exchanged water was added thereto and air in the reaction system was replaced thoroughly with nitrogen. 10 parts of trifluoropropyl methacrylate was added thereto and the temperature was elevated to 60° C. 0.105 part of 2,2'-azobis(2-amidinopropane) hydrochloride was added thereto to initiate the polymerization reaction. Then, 90 parts of trifluoroisopropyl methacrylate was added dropwise thereto over 1 h. After completion of the addition of the monomer, the mixture was aged at 60° C. for 1 h, cooled to room temperature and passed through a 100-mesh metal gauze to remove a coagulate formed in the course of the polymerization. Thus, a stable emulsion free of any smell of the unreacted monomer was obtained.

PREPARATION EXAMPLE 40

Comparative Product

A stable emulsion was prepared by the emulsion polymerization by using 0.105 part of 2,2'-azobis(2-amidinopropane) hydrochloride and 233 parts of ion-exchanged water, wherein 10 parts of JR-400 and 80 parts of methyl methacrylate were added dropwise successively in the same manner as in Preparation Example 32.

PREPARATION EXAMPLE 41

Comparative Product

A stable emulsion was prepared by the emulsion polymerization by using 0.105 part of 2,2-azobis(2-amidinopropane) hydrochloride and 233 parts of ion-exchanged water, wherein 10 parts of JR-400 70 parts of benzyl methacrylate and 20 parts of a reaction product of 2-hydroxyethyl acrylate and 3-chloro-2-hydroxypropyltrimethylammonium salt were added dropwise successively in the same manner as in Preparation Example 32.

PREPARATION EXAMPLE 42

Comparative Product

An emulsion was prepared by the emulsion polymerization by using 0.105 part of p-menthane hydroperoxide, 5 parts of a 1% aqueous solution of sodium formaldehyde sulfoxylate and 71.8 parts of ion-exchanged water, wherein 3.2 parts (2 parts in terms of solid content) of Kohtamin 86P conc., 17 parts of butyl acrylate and 3 parts of N (N',N'-diethylaminoethyl)methacrylamide were added dropwise successively and the product was quaternized with diethyl sulfate in the same manner as in Preparation Example 29.

The compositions of the products prepared in Preparation Examples 29 to 42 and the physical properties of them are shown in Table 14.

TABLE 14

| Color deepening agent | | Emulsifying dispersant | Monomers | Zeta potential (mV) | Refractive index | Tg (°C.) |
|---|---|---|---|---|---|---|
| Polymerization Technique 4 | Prep. Ex. 29 | Kohtamin 86P conc. | i-BuMA/MVP quaternized with diethyl sulfate | 59 | 1.47 | 52 |
| | Prep. Ex. 30 | Kohtamin 86P conc. | i-BuMA/DMAEM | 48 | 1.47 | 56 |
| | Prep. Ex. 31 | Kohtamin 86P conc. | PMA/DMAEVE quaternized with benzyl chloride | 52 | 1.47 | 25 |
| | Prep. Ex. 32 | Emulgen 935 | TFIPM/DEAEMA quaternized with dimethyl sulfate | 13 | 1.43 | 70 |
| | Prep. Ex. 33 | Emulgen 935 | TFIPM/(reaction product of BEM and TMA) | 28 | 1.42 | 71 |
| | Prep. Ex. 34 | JR-400 | MM/MG reacted with dimethylamine and then quaternized with diethyl sulfate | 38 | 1.48 | 97 |
| | Prep. Ex. 35 | JR-400 | MM/(reaction product of HEA and CHPTMA salt) | 42 | 1.49 | 95 |
| | Prep. Ex. 36 | Kohtamin 86P conc. | i-BuMA/N-MAM/IA/(MVP quaternized with benzyl chloride) | 48 | 1.47 | 52 |
| | Prep. Ex. 37 | Kohtamin 86P conc. | i-BuMA/MG/MA/DMAEVE | 52 | 1.47 | 49 |
| Comparative Preparation | Prep. Ex. 8 | Urethane emulsion | i-BuMA | 23 | 1.46 | 52 |
| | Prep. Ex. 38 | Kohtamin 86 conc. | i-BuMA/DMAEM | 98 | 1.47 | 51 |
| | Prep. Ex. 39 | Emulgen 935 | TFIPM | −10 | 1.47 | 72 |
| | Prep. Ex. 40 | JR-400 | MM | 33 | 1.48 | 95 |
| | Prep. Ex. 41 | JR-400 | BM/(reaction product of HEA and CHPTMA salt) | 35 | 1.58 | 46 |
| | Prep. Ex. 42 | Kohtamin 86 con. | BuA/DEAEMA quaterized with diethyl sulfate | 49 | 1.48 | −42 |

i-BuMA: isobutyl methacrylate
MVP: 2-methyl-5-vinylpyridine
DMAEM: N,N-dimethylaminoethyl methacrylate
PMA: propyl methacrylate
DMAEVE: 2-dimethylaminoethyl vinyl ether
TFIPM: trifluoroisopropyl methacrylate
DEAEMA: N-(N',N'-diethylaminoethyl)methacrylamide
BEM: 2-bromoethyl methacrylate
TMA: trimethylamine
MM: methyl methacrylate
MG: glycidyl methacrylate
HEA: 2-hydroxyethyl acrylate
CHPTMA: 3-chloro-2-hydroxypropyltrimethylammonium salt
N-MAM: N-methylolacrylamide
IA: itaconic acid
MA: methacrylic acid
BM: benzyl methacrylate
BuA: butyl acrylate Examples 12 to 16 were conducted in the same way as shown in Examples 1 to 5, respectively, using the compositions obtained by the polymerization (4). Example 17 was added.

EXAMPLE 12

Yellowing of a Cloth Treated with Color Deepening Agent

TABLE 15

| Color deepening agent | | Color deepening effect (L-value) padding-drying-curing process | immersion process | Yellowing by Light b value before exposure | b value after exposure | $\Delta_b$ |
|---|---|---|---|---|---|---|
| Polymerization Technique 4 | Prep. Ex. 29 | 12.6 | 12.8 | 0.3 | 0.5 | 0.2 |
| | Prep. Ex. 30 | 12.5 | 12.5 | 0.3 | 0.4 | 0.1 |
| | Prep. Ex. 31 | 12.7 | 12.8 | 0.2 | 0.4 | 0.2 |
| | Prep. Ex. 32 | 13.1 | 12.8 | 0.3 | 0.5 | 0.2 |
| | Prep. Ex. 33 | 12.9 | 12.8 | 0.4 | 0.5 | 0.1 |
| | Prep. Ex. 34 | 12.8 | 12.7 | 0.3 | 0.4 | 0.1 |
| | Prep. Ex. 35 | 12.7 | 12.6 | 0.2 | 0.4 | 0.2 |
| Comparative Preparation | Prep. Ex. 8 | 12.7 | 13.5 | 0.5 | 1.7 | 1.2 |
| | (treatment with water) | 14.5 | 14.5 | 0.2 | 0.3 | 0.1 |

The color deepening agents of the present invention exhibited excellent color deepening effects in both of the padding-drying-curing process and immersion-air drying process. They were scarcely yellowed by the exposure to the light for 80 h. On the other hand, the color deepening agent prepared in Preparation Example 8 using the urethane emulsion as protective colloid exhibited an insufficient color deepening effect in the immersion-air-drying process, though it exhibited an excellent color deepening effect in the padding-drying-curing process.

EXAMPLE 13

Zeta Potential and Color-deepening Effect of Emulsion

TABLE 16

| Color deepening agent | | Color deepening effect (L-value) polyester | silk | Physical properties zeta potential (mV) | refractive index | Tg (°C.) |
|---|---|---|---|---|---|---|
| Polymerization Technique 4 | Prep. Ex. 29 | 13.2 | 12.5 | 59 | 1.47 | 52 |
| | Prep. Ex. 30 | 13.3 | 12.6 | 48 | 1.47 | 56 |
| | Prep. Ex. 32 | 13.5 | 12.8 | 13 | 1.43 | 70 |
| | Prep. Ex. 33 | 13.3 | 12.7 | 28 | 1.42 | 71 |
| Comparative Preparation | Prep. Ex. 38 | 14.2 | 13.6 | 98 | 1.47 | 51 |
| | Prep. Ex. 39 | 14.8 | 14.0 | −10 | 1.47 | 72 |
| | (treatment with water) | 15.0 | 14.3 | — | — | — |

Though the refractive indexes and Tg in Preparation Examples 29, 30, 32, 33, 38 and 39 were the same, only the products of the present invention had an excellent color deepening effect.

It is considered that the product of Preparation Example 38could not be adsorbed on the fibers, since it had a zeta potential of as high as 97 mV and it was quite stable in water. Supposedly, the product of Preparation Example 39 having the same negative electric potential as that of the fiber surface could not be adsorbed on the fibers due to electrostatic repulsion.

EXAMPLE 14

Refractive Index and Color Deepening Effect

TABLE 17

| Color deepening agent | | Color deepening effect (L-value) | Physical properties refractive index | zeta potential (mV) | Tg (°C.) |
|---|---|---|---|---|---|
| Polymerization Technique 4 | Prep. Ex. 31 | 13.2 | 1.47 | 52 | 25 |
| | Prep. Ex. 33 | 13.0 | 1.42 | 28 | 71 |
| Comparative Preparation | Prep. Ex. 41 | 14.6 | 1.58 | 38 | 46 |
| | (treatment with water) | 14.8 | — | — | — |

The color deepening agents of the present invention exhibited an excellent color deepening effect, while that prepared in Prep. Ex. 41 and having a high refractive index exhibited no effect of deepening the color.

EXAMPLE 15

Tg and Color Deepening Effect

TABLE 18

| Color deepening agent | | Color deepening effect (L-value) Cotton | Wool | Physical properties Tg (°C.) | zeta potential (mV) | refractive index |
|---|---|---|---|---|---|---|
| Polymerization Technique 4 | Prep. Ex. 29 | 13.1 | 12.5 | 52 | 59 | 1.47 |
| | Prep. Ex. 31 | 13.2 | 12.7 | 25 | 52 | 1.47 |
| | Prep. Ex. 35 | 13.0 | 12.7 | 95 | 42 | 1.49 |
| Comparative Preparation | Prep. Ex. 42 | 14.2 | 13.9 | −42 | 49 | 1.48 |
| | (treatment with water) | 14.5 | 14.0 | — | — | — |

Both of the color deepening agents of the present invention exhibited an excellent color-deepening effect. The color deepening agent prepared in Preparation Example 42 exhibited no effect of deepening the color, since its Tg was too low.

It is apparent from Examples 30 to 32 that the excellent color deepening effect cannot be obtained unless all of the zeta potential, refractive index and Tg of the color deepening effect are optimum.

EXAMPLE 16

Crosslinkable Group and Color Deepening Effect

TABLE 19

| Color deepening agent | | L-value of cloth dyed in black | $\sqrt{a^2+b^2}$ of cloth dyed in red |
|---|---|---|---|
| Polymerization Technique 4 | Prep. Ex. 29 | 13.0 | 49.9 |
| | Prep. Ex. 30 | 13.1 | 49.8 |
| | Prep. Ex. 36 | 12.6 | 52.4 |
| | Prep. Ex. 37 | 12.7 | 52.1 |
| Comparative Preparation | Prep. Ex. 8 | 13.6 | 48.8 |
| | (treatment with water) | 15.1 | 48.2 |

All of the color deepening agents of the present invention exhibited an excellent color deepening effect. Among them, those prepared by the copolymerization with monomers having a crosslinkable group in Preparation Examples 36 and 37 exhibited a particularly excellent color deepening effects.

EXAMPLE 17

Addition of Cationic Monomer and Mechanical

An aqueous dispersion of 6 g/l (in terms of solid content) of an aqueous resin composition shown in Table 20 was prepared. The dispersion was stirred with a homomixer at 8,000 rpm for 10 min and filtered through a black filter paper to evaluate the mechanical stability thereof.

The results are shown in Table 20.

TABLE 20

| Color deepening agent | | Mechanical stability (macroscopic observation) |
|---|---|---|
| Polymerization Technique 4 | Prep. Ex. 29 | no coagulation |
| | Prep. Ex. 32 | no coagulation |
| | Prep. Ex. 35 | no coagulation |
| Comparative Preparation | Prep. Ex. 39 | a large amount of coagulum |
| | Prep. Ex. 40 | slight coagulation |

The color deepening agent of the present invention prepared by the copolymerization with the cationic monomer was resistant to powerful mechanical stirring and no coagulum was formed by the stirring even when the dispersant was partially released, since it had a self-dispersing function. The results of this test suggests that the color deepening agent of the present invention exhibits an excellent bath stability also in the in-site fabrication.

On the contrary, when the comparative color deepening agent was mechanically stirred, the particles in the emulsion were sheared and the dispersant was partially released to form a coagulum.

What is claimed is:

1. A shade enhancing agent comprising an aqueous resin composition obtained by radical emulsion polymerization of a polymerizable monomer component comprising a first polymerizable monomer ingredient selected from the group consisting of fluorinated acrylic esters, fluorinated methacrylic esters, vinyl ether, $\alpha,\beta$-ethylenically unsaturated carboxylic acid esters, vinyl esters and mixtures thereof, in the presence of a cationic protective colloid of dimer acid/diethylenetriamine polycondensate neutralized with phosphoric acid, a dry film of said composition having a glass transition temperature (Tg) in the range of from 20° C. to 110° C. and a refractive index of 1.50 or less, said aqueous resin composition having a zeta potential in the range of from +5 to +80 mV at an ion strength of $10^{-3}$ and a pH value of 7.

2. A shade enhancing agent as claimed in claim 1, in which said polymerizable monomer component is a mixture of said first polymerizable monomer ingredient and a second polymerizable monmomer ingredient selected from the group consisting of $\alpha$,62 -ethylenically unsaturated carboxylic acids, $\alpha,\beta$-ethylenically unsaturated carboxamides, substituted unsaturated carboxylic acid amides, heterocyclic vinyl compounds, allyl compounds, glycidyl methacrylate and mixtures thereof, the weight ratio of said first polymerizable monomer ingredient/said second polymerizable monomer ingredient being from 99.9/0.1 to 50/50.

3. An agent as claimed in claim 1 in which, in said polymerizing step, the polymerization reaction mixture comprises 50 to 99.5 wt. % of said monomer component, 0.5 to 50 wt. % of said cationic protective colloid, and water.

4. An agent as claimed in claim 1 in which said emulsion composition has a resin solid content of 0.1 to 50 grams per 1 liter.

5. A shade enhancing agent as claimed in claim 1 in which said first monomer ingredient comprises one or a mixture of two or more monomers selected from the group consisting of fluorooctyl acrylate, tetrafluro-3-(pentafluoroethoxy)propyl acrylate, heptafluorobutyl acrylate, 2-(heptafluorobutoxy)ethyl acrylate, trifluoroisopropyl methacrylate, 2,2,2-trifluoro-1-methylethyl methacrylate, vinyl isobutyl ether, vinyl ethyl ether, vinyl butyl ether, butyl acrylate, ethyl acrylate, 2-ethoxyethyl acrylate, isopropyl methacrylate, n-butyl methacrylate, n-hexyl methacrylate, methyl methacrylate, vinyl acetate and vinyl propionate.

6. A shade enhancing agent as claimed in claim 2 in which said first polymerizable monomer ingredient is one or a mixture of two or more monomers selected from the group consisting of flurooctyl acrylate, tetrafluro-3-(pentafluoroethoxy)propyl acrylate, heptaflurobutyl acrylate, 2-(heptaflurobutoxy)ethyl acrylate, trifluroisopropyl methacrylate; 2,2,2-trifluoro-1-methylethyl methacrylate, vinyl isobutyl ether, vinyl ethyl ether, vinyl butyl ether, butyl acrylate, ethyl acrylate, 2-ethoxyethyl acrylate, isopropyl methacrylate, n-butyl methacrylate, n-hexyl methacrylate, methyl methacrylate, vinyl acetate and vinyl propionate;

and said second polyerizable monomer ingredient is one or a mixture of two or more monomers selected from the group consisting of itaconic acid, acrylic acid, emthacrylic acid, fumaric acid, maleic acid, acrylamide, methacrylamide, maleamide, maleimide, methylolacrylamide, methylolmethacrylamide, methoxymethyl acrylamide, N-isobutoxymethylacrylamide, vinylpyridine, vinylpyrolidone, allyl alcohol, allyl acetate and glycidyl methacrylate.

7. A shade enhancing agent as claimed in claim 1 in which said first polymerizable monomer ingredient consists of n-butyl methacrylate.

8. A shade enhancing agent as claimed in claim 1 in which said first polymerizable monomer ingredient is selected from the group consisting of n-butyl methacrylate, isopropyl methacrylate, pentadecafluorooctyl acrylate, methyl methacrylate and trifluoroisopropyl methacrylate.

9. A shade enhancing agent as claimed in claim 2 in which said first polymerizable monomer ingredient consists of $\alpha,\beta$-ethylenically unsaturated carboxylic acid ester and said second polymerizable monomer ingredient of $\alpha$-$\beta$-ethylenically unsaturated carboxylic acid.

10. A shade enhancing agent as claimed in claim 2 in which said first polymerizable monomer ingredient consists of n-butyl methacrylate and said second polymerizable monomer ingredient consists of itaconic acid.

11. A shade enhancing agent as claimed in claim 2 in which said first polymerizable monomer ingredient is selected from the group consisting of n-butyl methacrylate, isopropyl methacrylate, pentadecafluorooctyl acrylate, methyl methacrylate and trifluoroisopropyl methacrylate, and said second polymerizable monomer ingredient is selected from the group consisting of itaconic acid and methacrylic acid.

12. A shade enhancing agent comprising an aqueous resin composition obtained by radical emulsion polymerization of a polymerizable monomer component comprising a first plymerizable monomer ingredient of an $\alpha,\beta$-ethylenically unsaturated carboxylic acid ester, in the presence of a cationic protective colloid of dimer acid/diethylenetriamine polycondensate neutralized with phosphoric acid, a dry film of said composition having a glass transition temperature (Tg) in the range of from 20° C. to 110° C. and a refractive index of 1.50 or less, said aqueous resin composition having a zeta potential in the range of from +5 to +80 mV at an ion strength of $10^{-3}$ and a pH value of 7.

13. A shade enhancing agent as claimed in claim 12, in which said polymerizable monomer component is a mixture of said $\alpha,\beta$-ethylenically unsaturated carboxylic acid ester and an $\alpha,\beta$-ethylenically unsaturated carboxylic acid.

14. A shade enhancing agent as claimed in claim 12, in which said polymerizable monomer component is a mixture of n-butyl methacrylate and itaconic acid.

* * * * *

UNITED STATES PATENT AND TRADEMARK OFFICE

CERTIFICATE OF CORRECTION

PATENT NO. : 5,126,392
DATED : June 30, 1992
INVENTOR(S) : Norihiko Nakashima, et. al.

It is certified that error appears in the above-indentified patent and that said Letters Patent is hereby corrected as shown below:

Column 36, Line 44; change "monmomer" to ---monomer---.

Column 36, Line 45; change "62" to ---β---.

Column 37, Lines 10-11;
change "acrylate, trifluroisopropyl"
to ---acrylate, trifluroisopropyl---.

Column 37, Line 20;
change "emthacrylic"
to ---methacrylic---.

Column 38, line 2; after "ingredient" insert ---consists---.

Signed and Sealed this

Twenty-eighth Day of September, 1993

Bruce Lehman

*Attest:*

BRUCE LEHMAN

*Attesting Officer*

*Commissioner of Patents and Trademarks*